US010861644B2

(12) United States Patent
Looby

(10) Patent No.: US 10,861,644 B2
(45) **Date of Patent: *Dec. 8, 2020**

(54) METHOD FOR MAKING AMORPHOUS METAL TRANSFORMER CORES

(71) Applicant: LAKEVIEW METALS, INC., Antioch, IL (US)

(72) Inventor: Kevin C. Looby, Wadsworth, IL (US)

(73) Assignee: LAKEVIEW METALS, INC., Antioch, IL (US)

( * ) Notice: Subject to any disclaimer, the term of this patent is extended or adjusted under 35 U.S.C. 154(b) by 300 days.

This patent is subject to a terminal disclaimer.

(21) Appl. No.: 15/969,718

(22) Filed: May 2, 2018

(65) Prior Publication Data

US 2018/0247761 A1 Aug. 30, 2018

Related U.S. Application Data

(63) Continuation of application No. 14/773,570, filed as application No. PCT/US2014/024366 on Mar. 12, 2014, now Pat. No. 9,978,513.

(Continued)

(51) Int. Cl.
*H01F 7/06* (2006.01)
*H01F 41/02* (2006.01)

(52) U.S. Cl.
CPC .... *H01F 41/0226* (2013.01); *Y10T 29/49075* (2015.01); *Y10T 29/49078* (2015.01)

(58) Field of Classification Search
CPC .... H01F 27/25; H01F 27/24; Y10T 29/49078; Y10T 29/4902; Y10T 29/49075; Y10T 29/49002; Y10T 29/49009; Y10T 29/5317

(Continued)

(56) References Cited

U.S. PATENT DOCUMENTS 4,413,406 A 11/1983 Bennett et al.
5,050,294 A 9/1991 Ballard et al.

(Continued)

FOREIGN PATENT DOCUMENTS

GB 589529 6/1947

OTHER PUBLICATIONS

International Search Report and Written Opinion for Int. App. No. PCT/US2014/024366, dated Jul. 15, 2014.

*Primary Examiner* — Thiem D Phan
(74) *Attorney, Agent, or Firm* — McDonnell Boehnen Hulbert & Berghoff LLP

(57) ABSTRACT

A method for assembling an amorphous metallic transformer core includes providing at least one coil of amorphous metallic strip, unwinding the amorphous metallic strip from the coil, utilizing a roll feed to transport the amorphous strip along a longitudinal direction through a shearing section, along a bridge plate, and into an accumulator roll, advancing a first end of the amorphous strip into the accumulator roll a predetermined distance, stopping the accumulator roll while the roll feed continues to feed the amorphous strip at a set speed, moving the bridge plate from a closed position to an open position, moving a deflector plate from a non-deflecting position to a deflecting position, continuing to operate the roll feed so that a first desired feed length of the amorphous strip is achieved, and shearing the amorphous strip at the first desired feed length to produce an amorphous strip comprising the desired feed length.

12 Claims, 10 Drawing Sheets

Related U.S. Application Data

(60) Provisional application No. 61/779,716, filed on Mar. 13, 2013.

(58) Field of Classification Search
USPC ..... 29/607, 564.6, 564.8, 602.1, 604, 605, 29/606, 609, 738, 757
See application file for complete search history.

(56) References Cited

U.S. PATENT DOCUMENTS

| | | | | |
|---|---|---|---|---|
| 5,261,152 | A | 11/1993 | Simozaki et al. | |
| 5,285,565 | A | 2/1994 | Ballard et al. | |
| 5,291,648 | A * | 3/1994 | Ballard | H01F 41/0226 29/564.6 |
| 5,347,706 | A * | 9/1994 | Klappert | H01F 41/024 29/609 |
| 8,375,569 | B2 | 2/2013 | Fukui et al. | |
| 8,959,752 | B2 | 2/2015 | Ikeda et al. | |
| 2012/0047718 | A1 | 3/2012 | Ikeda et al. | |

* cited by examiner

METHOD FOR MAKING AMORPHOUS METAL TRANSFORMER CORES

CROSS-REFERENCE

The present application is a continuation of U.S. patent application Ser. No. 14/773,570, filed Sep. 8, 2015, which is a U.S. National Phase Application pursuant to 35 U.S.C. § 371 of International Application No. PCT/US2014/024366 filed Mar. 12, 2014, which claims priority to U.S. Provisional Patent Application No. 61/779,716 filed Mar. 13, 2013. The entire disclosure contents of these applications are herewith incorporated by reference into the present application.

BACKGROUND

Field of the Present Patent Application

The present patent application is generally directed to a transformer core comprising a plurality of amorphous metal strips. Specifically, the present patent application is generally directed to a method and apparatus for making an electric transformer core comprising a plurality of metallic strip packets or groups, each packet or group may comprise a plurality of thin amorphous metal strips. These thin strips of amorphous metal are arranged in a collection of packets or groups comprising multiple-strip lengths. These collections are then arranged to surround a window of a core of the transformer where the window of the core first resides on a winder. However, aspects of the present application may be equally applicable in other scenarios as well.

Description of Related Art

Electrical-power transformers are used extensively in various electrical and electronic applications. For example, transformers transfer electric energy from one circuit to another circuit through magnetic induction. Transformers are also utilized to step electrical voltages up or down, to couple signal energy from one stage to another, and to match the impedances of interconnected electrical or electronic components. Transformers may also be used to sense current, and to power electronic trip units for circuit interrupters. Still further, transformers may also be employed in solenoid-equipped magnetic circuits, and in electric motors.

A typical transformer includes two or more multi-turned coils of wire commonly referred to as "phase windings." The phase windings are placed in close proximity so that the magnetic fields generated by each winding are coupled when the transformer is energized. Most transformers have a primary winding and a secondary winding. The output voltage of a transformer can be increased or decreased by varying the number of turns in the primary winding in relation to the number of turns in the secondary winding.

The magnetic field generated by the current passing through the primary winding is typically concentrated by winding the primary and secondary coils on a core of magnetic material. This arrangement increases the level of induction in the primary and secondary windings so that the windings can be formed from a smaller number of turns while still maintaining a given level of magnetic-flux. In addition, the use of a magnetic core having a continuous magnetic path helps to ensure that virtually all of the magnetic field established by the current in the primary winding is induced in the secondary winding. An alternating current flows through the primary winding when an alternating voltage is applied to the winding. The value of this current is limited by the level of induction in the winding.

The current produces an alternating magnetomotive force that, in turn, creates an alternating magnetic flux. The magnetic flux is constrained within the core of the transformer and induces a voltage across in the secondary winding. This voltage produces an alternating current when the secondary winding is connected to an electrical load. The load current in the secondary winding produces its own magnetomotive force that, in turn, creates a further alternating flux that is magnetically coupled to the primary winding. A load current then flows in the primary winding. This current is of sufficient magnitude to balance the magnetomotive force produced by the secondary load current. Thus, the primary winding carries both magnetizing and load currents, the secondary winding carries a load current, and the core carries only the flux produced by the magnetizing current.

Certain modern transformers generally operate with a high degree of efficiency.

Magnetic devices such as transformers, however, undergo certain losses because some portion of the input energy to the transformer is inevitably converted into unwanted losses such as heat. A most obvious type of unwanted heat generation is ohmic heating—heating that occurs in the phase windings due to the resistance of the windings.

Traditionally, electrical transformer cores have been formed completely of high grain oriented silicon steel laminations. Over the years, improvements have been made in such high grained oriented steels to permit reductions in transformer core sizes, manufacturing costs and the losses introduced into an electrical distribution system by the transformer core. As the cost of electrical energy continues to rise, reductions in core loss have become an increasingly important design consideration in all sizes of electrical transformers.

In order to reduce these undesired affects of such high grain oriented steel type transformers, amorphous metals having a non-crystalline structure have been used in forming electromagnetic devices, such as cores for electrical transformers. Generally, amorphous metals have been used because of their superior electrical characteristic relative to high grain oriented silicon steel laminations. For this reason, amorphous ferromagnetic materials are being used more frequently as transformer base core materials in order to achieve a decrease in transformer core operating losses.

Generally, amorphous metals may be characterized by a virtual absence of a periodic repeating structure on the atomic level, i.e., the crystal lattice. The non-crystalline amorphous structure is produced by rapidly cooling a molten alloy of appropriate composition such as those described by Chen et al., in U.S. Pat. No. 3,856,513, herein incorporated by reference and to which the reader is directed for further information. Due to the rapid cooling rates, the alloy does not form in the crystalline state. Rather, the alloy assumes a metastable non-crystalline structure representative of the liquid phase from which the alloy was formed. Due to the absence of crystalline atomic structure, amorphous alloys are frequently referred in certain literature and elsewhere as "glassy" alloys.

Due to the nature of the manufacturing process, an amorphous ferromagnetic strip suitable for winding a distribution transformer core, for example, is extremely thin. For example, the thickness of a typical amorphous metallic strip may nominally be on the order of 0.025 mm versus a thickness of approximately 0.250 mm for typical grain oriented silicon steel. Moreover, such amorphous metallic strips are quite brittle and are therefore easily damaged or fractured during the processing and handling of such strips. For example, a typical amorphous metallic strip may nominally. Consequently, the handling, processing, and fabrication of wound amorphous metal cores presents certain unique manufacturing challenges of handling the very thin strips. This is particularly present throughout the various manufacturing steps of winding the core, cutting and rearranging the core laminations into a desired joint pattern, shaping and annealing the core, and finally lacing the core through the window of a preformed transformer coil. Of particular importance is the lacing step which must be effected with heightened care so as to avoid permanently deforming the core from its annealed configuration after the core has been laced into the coil window. That is, if the core is not exactly returned to its annealed shape, stresses are introduced during the lacing procedure. Consequently, if there are significant stresses remaining after lacing, the potential low core loss characteristic offered by the amorphous metal core material is not achieved. Since amorphous metal laminations are quite weak and have little resiliency, they are readily disoriented during the lacing step, resulting in permanent core deformation if not corrected. In addition to this concern, there is also a potential concern that the lacing step is carried out with sufficient care such as to avoid fracturing the brittle amorphous metal laminations.

However, the relatively thin strips ribbons of amorphous metals present certain core manufacturing challenges during the handing, processing, assembly and annealing of such amorphous metal transform cores. As just one example, certain amorphous metal transformer cores generally require a greater number of laminations or groupings or stacks of strips in order to form a desired amorphous metal core. As such, amorphous metal cores comprising a larger number of laminations tend to present certain difficulties and challenges in handling during the various processing steps that may be involved as the plurality of metallic strip groupings and collections are eventually processed, sheared, and then formed into an amorphous metal core.

In addition, the magnetic properties of the amorphous metals have been found to be deleteriously affected by mechanical stresses such as those created by the fabricating steps of winding and forming the amorphous metal groupings and stacks into a desired core shape.

Certain known methods and/or systems for manufacturing amorphous metal transformer cores are known have attempted to solve or reduce these known manufacturing challenges. As just one example, U.S. Pat. No. 5,285,565 entitled "Method for Making a Transformer Core Comprising Amorphous Steel Strips Surrounding The Core Window" herein entirely incorporated by reference and to which the reader is directed, teaches such a method and system for making a transformer core comprising a plurality of groupings of amorphous metal strips. As described in U.S. Pat. No. 5,285,565, the disclosed method utilizes a plurality of spools of amorphous steel strip in each of which the strip is wound in a single-layer thickness. For example, and as illustrated in FIG. 1 of U.S. Pat. No. 5,285,565, a pre-spooler comprising five starting spools is illustrated. As the inventors describe in this patent, the strip from the five starting spools must first be unwound and then re-wound onto the pre-spooler. In this manner, the five single ply spools are unwound so as to create a five (5) ply ribbon or strip that then must be wound onto the pre-spooler.

During a subsequent processing step, by way of a pre-spooling machine, the single-layer thickness amorphous metal strips from the five starting spools are unwound. In a subsequent processing step, these single-layer thickness strips are then combined to form a strip of multiple-layer thickness (a five ply composite strip) that is then wound onto a plurality of master reels, on each of which the strip is wound in multiple-layer thickness. These master reels comprising the amorphous metal strips of multiple-layer thickness are then placed on a plurality of payoff reels.

In a next process step, these various multiple-layer thickness strips are unwound from these payoff reels and then combined into a final composite metallic strip.

This final composite metallic strip would then comprise an overall thickness in strip layers equal to the sum of the strip layers in the combined multiple-layer thickness strips. Finally, the composite strip is cut into a plurality of groupings or packets, or lengths of composite strip. These plurality of groupings or packets are then constructed onto a hollow core, which form has a window about which the various cut sections are wrapped.

Although the pre-spooler and master spool system and methods disclosed in U.S. Pat. No. 5,285,565 purports to provide certain advantages over other known methods of amorphous metal transformer core manufacturing, there are a number of perceived disadvantages of utilizing such a system comprising one or more master spools or multiple-ply coils. For example, with such a system comprising a plurality of multiple-ply coils, each single coil must first be mounted onto an uncoiler and then single-ply strip must be unwound and then fed into the pre-spooler in a controller and uniform manner. As such, there is an associated set up cost, labor cost and machine cost associated with first mounting and then unwinding five single sheet spools and then rewinding them back into a 5-ply spool.

In addition, there is an associated additional machine cost since an amorphous transformer core manufacturer is required to purchase, install, and maintain not only a pre-spooler and a master-spooler but also a separate apparatus that combines the multiple-layer thickness strips unwound from the plurality of master spools. As such, addition manufacturing floor space must be allocated not only to the machine for pre-spooling but also for the overall assembly apparatus for fabricating the transformer core itself.

In addition, with the multiple-ply coil system described above, each of the five individual amorphous metal strips within the five-ply group will wrap up around the spool at a slightly different diameter. That is, with the five-ply metal strip grouping, the outer or top most metallic strip will be slightly longer than the inner or bottom most metallic strip since the outer or top most strip most wrap around the spool at a slightly larger spool diameter. As such, each of the various metal strips wound around a multiple-ply coil will comprise different lengths. Therefore, after running a number of laps off the five-ply coil during assembly of the transformer core (such as the five-ply coil illustrated in U.S. Pat. No. 5,285,565), an operator of the overall system must first stop the entire line since eventually one of the outer most strips within a five-ply coil will eventually be longer than the other strips within the grouping. After stopping the machine, the operator must then somehow remove the extra material from the longer of the five strips so as to even these lengths up so that all of the strips of the multi-ply coil comprise the same overall length. As those of skill in the art will recognize, oftentimes, the machine operator will either cut or tear this "extra" amorphous strip material from longer strip so that all of the sheets will comprise the same length. Repeatedly stopping, removing the excess amorphous strip material, and starting the overall system back up again increases overall manufacture costs by increasing overall system down time and driving up overall labor costs per pound of the to be manufactured transformer cores. In addition, in the prior art apparatus as illustrated in U.S. Pat. No. 5,285,565, an operator would have to remove this excess amorphous strip material from not just one multi-ply coil but from a total of four multi-ply coils since they would all unwind uniformly. Moreover, constant starting and stopping these heavy duty pre-spooling and spooling machines also increases the overall wear and tear on the machinery.

In addition, after having to repeatedly stop and then restart the overall combining apparatus as illustrated in U.S. Pat. No. 5,285,565, the machine operator must then, at the various points of the longest metallic strips cut or tear the amorphous strips, and then somehow re-connect the torn strip materials. Again, for a combining apparatus as illustrated in this prior art patent, an operator must cut or tear at least four amorphous strips. Then, the operator must apply some type of adhesive or connecting mechanisms (e.g., such as a high temperature resistant tape) so as to hold the loose or torn amorphous metal strips back together. This of course adds further costs to the overall manufacturing process while also driving up overall processing and manufacturing times. In addition, placing the adhesive or connecting mechanism (such as tape) can cause further manufacturing challenges downstream of the uncoilers when running a composite metallic strip comprising a plurality of these thin metallic strips at relatively high speeds.

In addition, certain high temperature resistant tapes that are typically used in this assembly process can cause further complications during subsequent process steps of the amorphous metallic cores. As just one example, one high temperature resistant tape this is typically used to hold these torn amorphous metallic strips together is Kapton tape. As those of skill in the art will recognize, one advantage to using Kapton tape to hold these loose metallic strips together is that this high temperature tape is generally known to remain relatively stable even when used in a wide range of temperatures. For example, Kapton tape tends to remain stable if it is heated from about −273 to about +400 degrees Celsius.

However, use of such a high temperature tape to reconnect the amorphous metal strips presents certain problems during transformer core manufacturing. First, Kapton tape is quite expensive and therefore use of such tape increases the overall cost of manufacturing. In addition, and as discussed above, because of its stability in a wide rage of temperatures, Kapton tape is resistant to burning at temperatures used during the transformer annealing process, typically on the order of 330 to 470 degrees Celsius. Because of its resistance to burning during the transformer core annealing process, the Kapton tape can cause certain problems during the transformer annealing process.

Certain other tapes that do not resist burning at transformer core annealing temperatures can leave a residue from the burned tape in the transformer core. Such tape residue can cause other problems. For example, in one worst case scenario, such tape residue can react with the transformer oil. As another example, after the transformer core annealing step, certain tapes may result in a residue that can stain the strips in the transformer core and possibly cause rust in the core.

Accordingly, Applicants' presently proposed method and apparatus is directed to manufacturing and providing an amorphous metal transformer core that is cost effective to manufacture, that has low energy losses, and that is energy efficient. Applicants' proposed method and apparatus is also directed to an amorphous metal transformer core in which the difficulties of handling and processing the amorphous metal strips to perform the manipulative steps of the fabrication process are reduced and the mechanical stresses induced into the amorphous metal strips and hence the core during its fabrication process are reduced. In addition, in Applicants presently disclosed systems and methods, fabrication of the amorphous metal core process is simplified since it does not require a pre-spooling step and therefore a costly pre-spooling machine and corresponding maintenance and manufacturing floor space for placement of such a machine.

In addition, Applicants' presently disclosed system and method reduces the overall time for fabricating a desired amorphous metal transformer core. Moreover, with Applicants' presently disclosed system and method reduces the amount of scrap metallic strip material generated during manufacturing since the system operator no longer needs to stop the entire process so as to remove a portion of the multi-ply strip groupings so as to even out the metallic strips of unequal length and then reconnect the metallic strip. As such, there is no longer a need to use a high temperature tape or other type of connection mechanism so as to connect the loose strip ends of the amorphous material. These and other objects of the Applicants disclosed systems and method will become apparent to those skilled in the art upon consideration of the following illustrations and detailed description.

SUMMARY

According to an exemplary embodiment, an apparatus for assembling an amorphous metallic transformer core from a plurality of amorphous metallic strip packets comprises an unwinding section comprising a plurality of uncoilers. Each of the plurality of uncoilers operated to unwind a coil comprising a single-ply continuous strip of a metallic material. A collection tray is configured to transport a composite metallic strip from the unwinding section, the composite metallic strip comprising a plurality of single ply metallic strips that are unwound from the plurality of uncoilers of the unwinding section. A shearing section operably coupled to the collection tray and configured to receive the composite metallic strip from the unwinding section, the shearing section configured to shear the composite metallic strip into a plurality of packets, the shearing section comprising an accumulator for holding the plurality of the packets of the composite metallic strips. A winding section is configured to receive the plurality of the packets of the composite metallic strips from the shearing section, the winding section forming a metallic transformer core from the plurality of packets of the composite metallic strips.

These as well as other advantages of various aspects of the present patent application will become apparent to those of ordinary skill in the art by reading the following detailed description, with appropriate reference to the accompanying drawings.

BRIEF DESCRIPTION OF THE DRAWINGS

Exemplary embodiments are described herein with reference to the drawings, in which.

DETAILED DESCRIPTION

Figure 1:
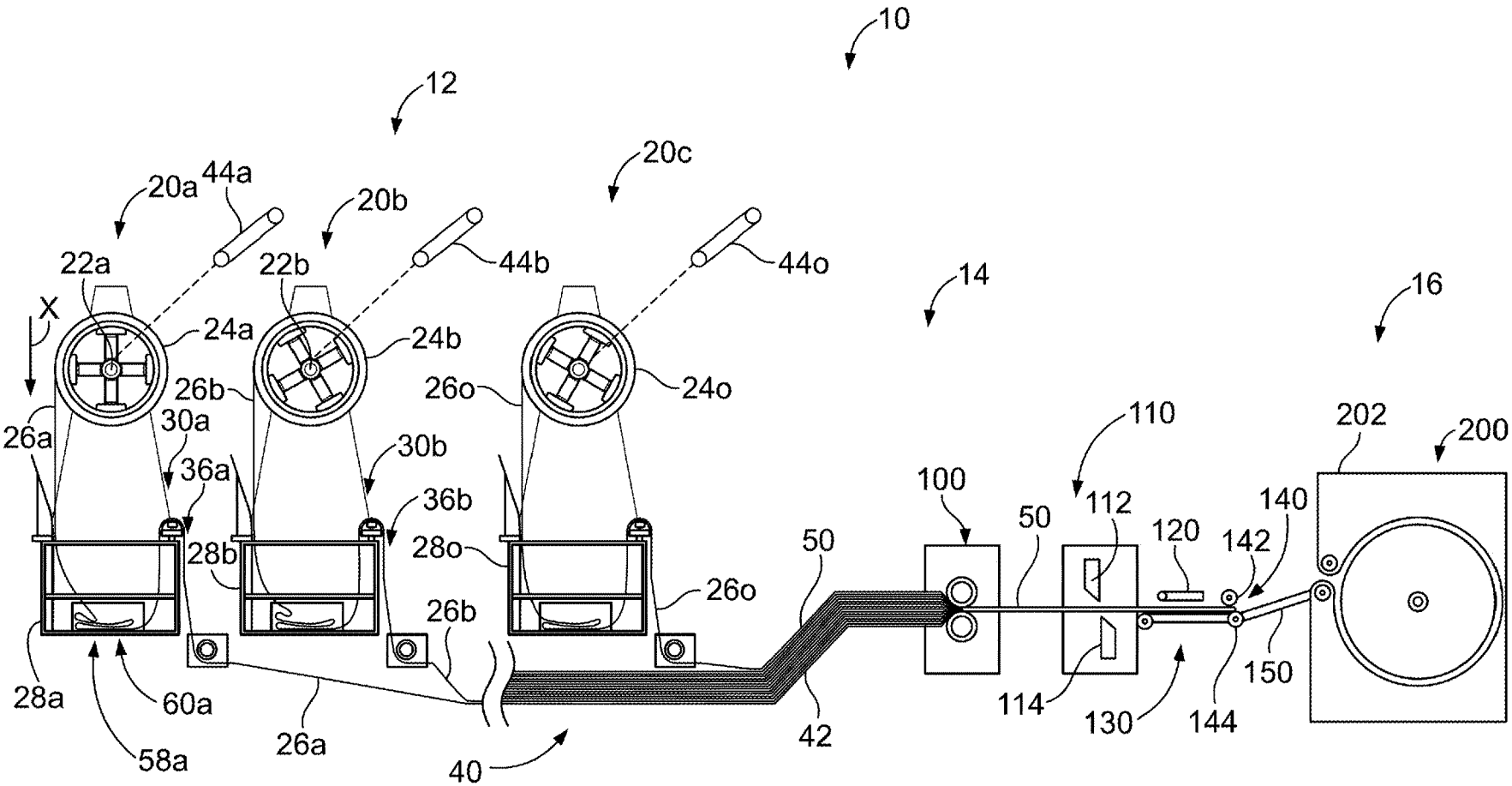
FIG. 1 illustrates a schematic side elevation view of an apparatus used for processing a transformer core comprising amorphous metal strips in accordance with certain aspects of the present patent application.
Figure 20:
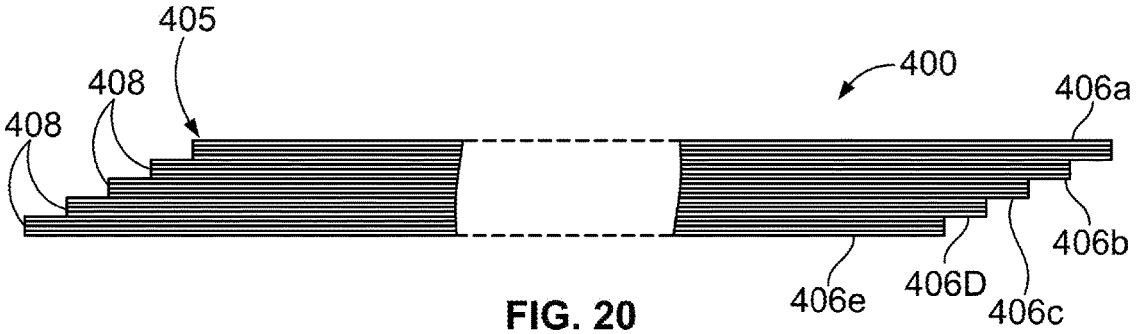
FIG. 20 illustrates a side view of a group or a packet of metal strips that can be fabricated by way of the presently disclosed method and apparatus, such as the apparatus illustrated in FIG. 1.
Figure 21:
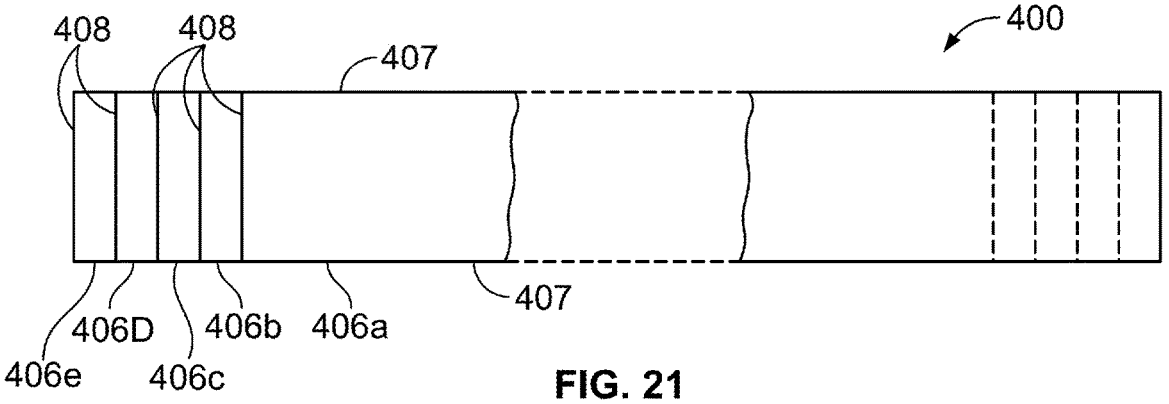
FIG. 21 illustrates a top plan view of the packet of metallic strips illustrated in FIG. 20, such as the apparatus illustrated in FIG. 1.

FIG. 1 illustrates a schematic side elevation view of an apparatus 10 used for processing a transformer core of amorphous metal strips in accordance with one aspect of the presently disclosed methods and systems. As will be described in greater detail below, the disclosed apparatus 10 may be used to assemble and process a stack or grouping of a plurality of amorphous strips, such as the grouping or stack of amorphous metallic strips 400 as illustrated in FIGS. 20 and 21.

As illustrated, the apparatus 10 comprises essentially three processing sections: an unwinding section 12, a shearing section 14, and a core winding section 16. In this illustrated embodiment of apparatus 10, the unwinding section 12 preferably comprises a plurality of uncoilers 20(*a-o*), a plurality of spools 24(*a-o*), and a common strip collection tray 40. In one preferred arrangement, this common strip collection tray 40 begins at the first uncoiler 20*a* and ends with a ramp 42 that allows a composite strip material 50 to be transported from the unwinding section 12 into the shearing section 14. For ease of illustration, only three uncoilers are illustrated in FIG. 1: the first uncoiler 20*a*, the second uncoiler 20*b*, and the last uncoiler (or the fifteenth uncoiler) 20*o*.

As illustrated, the shearing section 14 resides downstream of the unwinding section 12. In this preferred arrangement, the shearing section 14 comprises a roll feed 100, a shear 110, a deflector plate 120, a bridge plate 130, an accumulator roll 140, and a guide plate 150. A core winding section 16 comprising a winder 200 is positioned downstream of the shearing section 14. The core winding section 16 comprises a winding belt that is used to hold a plurality of amorphous strip packets about an arbor to build up a transformer core.

Specifically, and as described in greater detail below, apparatus 10 may be used to manufacture a plurality of groups or packets of amorphous metallic strips that can be further formed into a core and this core may then be used to fabricate an amorphous core transformer. As described, in one preferred arrangement, transformer cores are fabricated from a plurality of grouping of stacks wherein each grouping comprises a plurality of amorphous metal strips. In one alternative preferred arrangement, transformer cores are fabricated from a plurality of groupings wherein one grouping may comprise a plurality of amorphous metal strips and wherein certain other groupings may comprise non-amorphous metal strips (e.g., grain oriented silicon steel). Still further, transformer cores may be fabricated wherein certain groupings may comprise both a plurality of amorphous strips along with non-amorphous metal strips. In addition, and as those of skill in the art will recognize, alternative arrangements may also be implemented with the disclosed apparatus and methods.

As just one example, the fabricated core may be composed of a blend of amorphous and non-amorphous materials by adding one or more coils of non-amorphous material such as grain-oriented or high-silicon, non-oriented materials such as JFE SuperCore. By doing so, the core can then be composed of an evenly-distributed blend of amorphous and non-amorphous materials. Such a core would benefit from a cost blending of more expensive amorphous ribbon and less-expensive grain-oriented or non-oriented steels.

Additionally, a feed diverter could be utilized in the presently disclosed apparatus and one that could be added to optionally replace feeds of amorphous ribbon with non-amorphous material so as to alter the percentage of amorphous ribbon versus non-amorphous material such that the inner section of a core could be comprised of 100% non-amorphous ribbon, and amorphous ribbon added with the percentage of amorphous ribbon increasing through the buildup of the core so that the outer area of the core would be 100% amorphous. In this case, the use of a high-silicon non-oriented material such as JFE Supercore or other material which can be bent and not require annealing to recover performance losses would be preferred.

Alternatively, a core may be produced from a blend of amorphous ribbon, comprising a percentage of the outer area of the core wall, and an inner section of non-amorphous material such as grain-oriented steel or high silicon non-oriented such as JFE SuperCore. Since flux tends to concentrate around the shortest path length, the flux would be concentrated in the non-amorphous inner material which is capable at operating at higher flux densities and be present in the outer amorphous section at a lower flux density.

Conversely, depending on the performance properties of the amorphous and non-amorphous materials, it may be advantageous to arrange the amorphous material to be on the inner area of the core.

Metallic Strip Packets

Specifically, and now referring first to FIGS. 20 and 21, there is shown a packet 400 of metallic strips which are manufactured by the apparatus 10 illustrated in FIG. 1. As discussed above, this packet 400 may comprise all amorphous metal strips or a combination of amorphous and non-amorphous metal strips (non-grained oriented or grain oriented). This packet 400 comprises a plurality of groups 406 (*a-e*) of metal strips, each group comprising many thin layers of elongated strip. In this preferred illustrated packet, the packet 400 comprises five (5) groups 406 (*a-e*) of many thin layers of elongated strips. However, those of ordinary skill in the art will recognize that other packet strip embodiments may also be used.

In addition, preferably, each group 406 (*a-e*) may comprise a plurality of thin layers of elongated metal strips. As just one example, each group 406 (*a-e*) comprises 15 thin layers of elongated strip. However, other group and strip arrangements may also be used. For example, group 406 (*a-e*) may comprise 15 thin layers of elongated strip wherein each one of the 15 layers is uncoiled from each respective uncoiler illustrated in FIG. 1. For example, the first layer 406*a* may be uncoiled from the first uncoil 24*a*, the second thin layer may be uncoiled from the second coiler 24*b*, etc.

In each group, the layers of metallic strips have longitudinally-extending edges 407 at opposite sides thereof and transversely-extending edges 408 at opposite ends thereof. In each group 406 *a-e*, the longitudinally-extending edges 407 of the strips at each side of the group are aligned. In addition, in each group 406 *a-e*, the transversely-extending edges 408 of the strips at each end of the group are aligned. In the illustrated packets of FIGS. 20 and 21, the groups 406 are made progressively longer beginning at the bottom of the packet 400 (or inside of the packet 400) and proceeding toward the top of the packet (or toward the outside of the packet 400). As will be described in greater detail below, the increased length of these groupings of the metallic strips enables the groups 406 (*a-e*) to completely encircle the increasingly greater circumference of the transformer core form as the core form is built up on the winder section 16, that is, when the plurality of packets are wrapped about an arbor provided by way of the winding section 16 of the apparatus 10 illustrated in FIG. 1. As described in greater detail below, these packets are wrapped about an arbor with their inside, or shortest, group nearest the arbor. That is, as just one example, for the metallic strip packet 400 illustrated in FIGS. 20 and 21, this packet will be wrapped about the arbor with the inside or shortest metallic group 406*e* nearest the arbor (i.e., nearest the inner diameter of the transformer core).

Referring still to FIGS. 20 and 21, adjacent groups in each packet 400 have their transversely-extending ends staggered so that at one end of the packet the adjacent groups underlap, and at the other end of the packet the adjacent groups overlap. For example, adjacent groups 406*a* and 406*b* have their transversely-extending ends staggered so that at one end of the packet the adjacent groups underlap, and at the other end of the packet the adjacent groups overlap. This staggering results in distributed type joints in the final core after the below-described wrapping about an arbor.

Transformer Core

Figure 22:
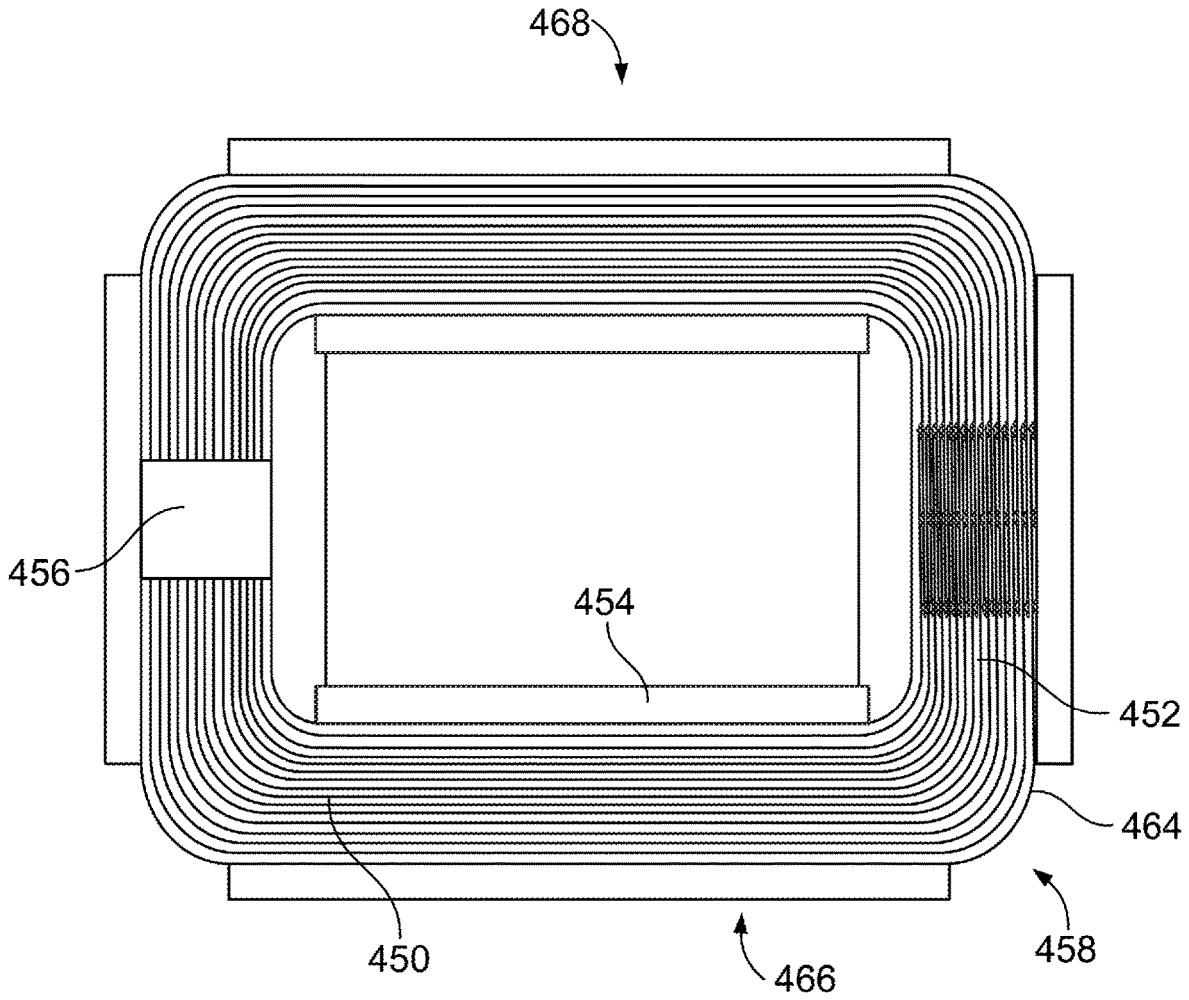
FIG. 22 illustrates a transformer core having a joint construction in accordance with one aspect of the present invention, utilizing a plurality of the packet of metallic strips illustrated in FIGS. 20 and 21.

FIG. 22 illustrates a transformer core 450 that may be manufactured from a plurality of strip stacks, such as a plurality of strip stacks illustrated in FIGS. 21 and 22.

As illustrated, this jointed core 450 includes a plurality of spirally wound metallic strip packets that may be initially wound as on a round or rectangular mandrel, such as the mandrel illustrated in the winder of FIG. 1. The circumference of the circular mandrel or the parameter of a rectangular mandrel is determined by the size of the core window desired to accommodate the high and low voltage coils of a finished transformer. Similarly, the number of spirally wound metallic strip packets is determined by the ultimate power rating of the transformer. However, as those of ordinary skill in the art will recognize, the number of desired amorphous metal strips may be determined by a particular electrical characteristics, electrical property, or a desired dimensions of the amorphous metal core as will be described in greater detail herein.

Referring now to FIG. 22, the magnetic core, generally designated 450, includes a plurality of individual metallic strip packets that have been cut to form the joint 452. Because of the flexibility of the amorphous metal strip packets, a fixture 454 may be employed to maintain the integrity of the core shape. Additionally, a band of adhesive or other suitable clamping means may be employed as at 456 so as to prevent undesired movement between the plurality of metallic strip packets. As illustrated in Phantom at 458, the joint 452 permits the core 450 to be opened to receive a high voltage coil and a low voltage coil. As best illustrated schematically in FIGS. 20 and 21, the packets are divided into a plurality of groups of packets and several sets of groups of packets. In FIGS. 20 and 21, approximately 7 laminations have been illustrated as defining a group of laminations but it should be understood that the number of metallic strips in a group could be from between about 5 and 30 metallic strips and is preferably approximately 15 metallic strips. As previously discussed, each group of metallic strips is offset laterally from its adjacent group of metallic strips and a certain number of these groups of strips are defined herein as a set of groups. In the illustration of FIGS. 20 and 21, three groups of strips constitute a set of groups but it should be understood that the number of groups of strips in a set of groups of strips is preferably between about 5 and 25 groups before it is necessary to step back or forward with respect to the direction of the spiral to repeat the sequence. The number of groups of strips in a set of groups is essentially controlled by the length of the top leg 464 of the rectangular core before that top leg begins to curve to form the side legs 466 and 468 of the magnetic core 450.

Apparatus General

Returning to FIG. 1, there is illustrated an overview of a method of the present invention to form an electromagnetic amorphous metal core for an electrical transformer, such as the magnetic core 450 illustrated in FIG. 22. The present patent application is primarily related to forming a plurality of amorphous metal sheet packets arranged from a plurality of amorphous strips provided on the plurality of coils 24 (*a-o*) provided on the plurality of uncoilers 20 (*a-o*). These packets are then formed into an electromagnetic core, such as the core 210 illustrated in FIG. 22. In one preferred arrangement, the amorphous metallic strip 50 is supplied as a continuous and relatively thin sheet formed as a coil 24.

Unwinding Section

Figure 2:
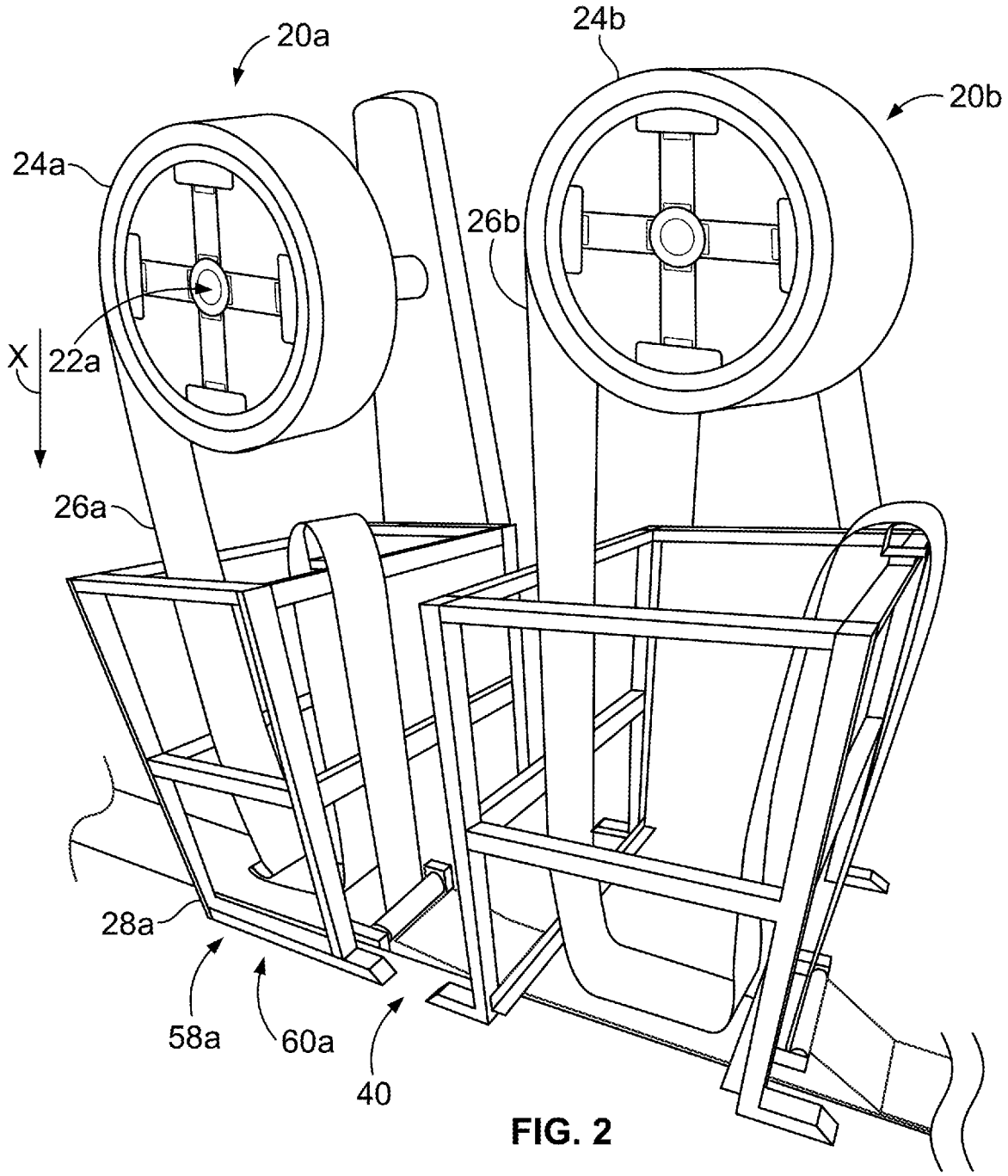
FIG. 2 illustrates a perspective close up view of two of the uncoilers that may be used with the apparatus illustrated in FIG. 1.
Figure 3:
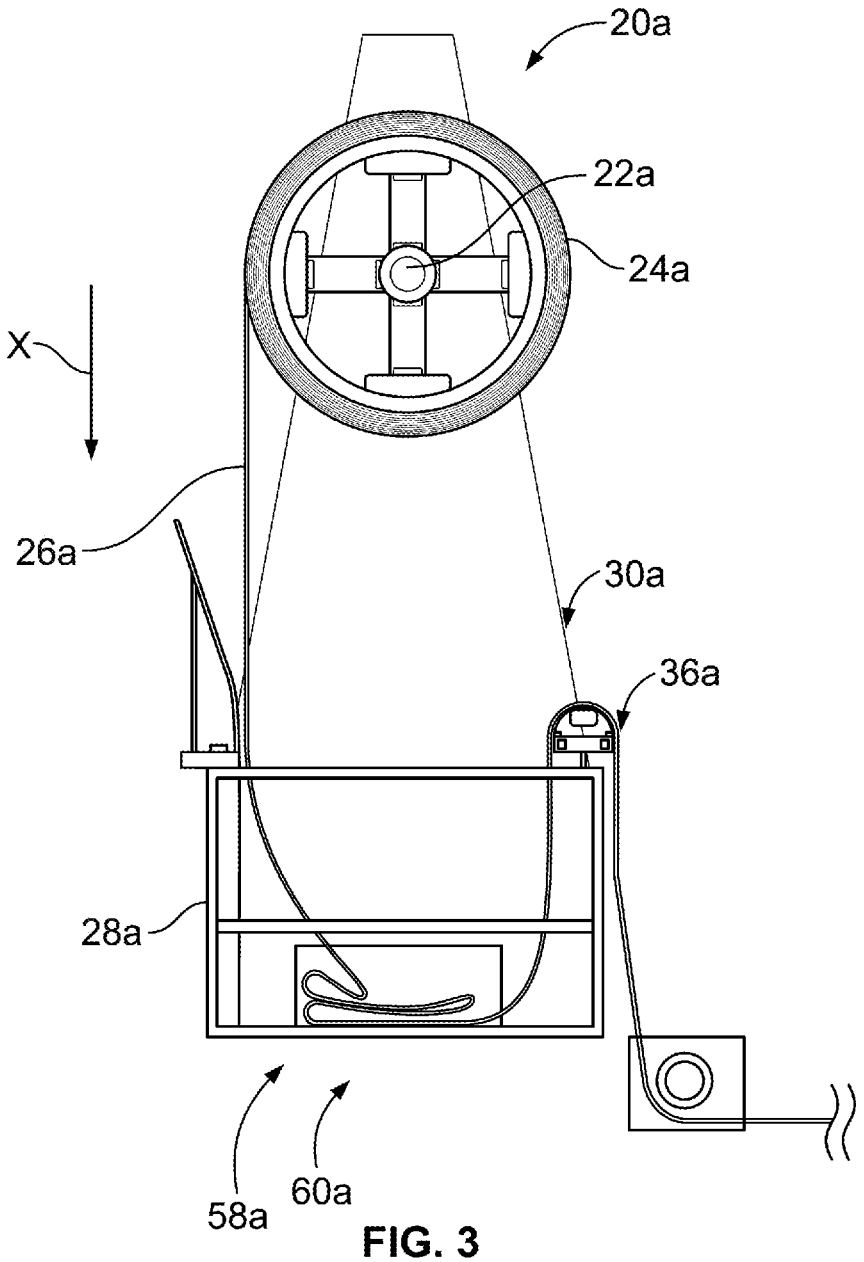
FIG. 3 illustrates a side view of one of the uncoilers illustrated in FIGS. 1 and 2.

Specifically, and referring back to FIG. 1, in one arrangement, the unwinding section 12 of apparatus 10 comprises fifteen (15) metallic strip uncoilers 20(*a-o*). FIG. 2 illustrates a close up perspective view of the first and the second uncoiler 20*a* and 20*b*, respectively, illustrated in the apparatus of FIG. 1. FIG. 3 illustrates a side view of the first uncoiler 20*a*.

Although this particular illustrated exemplary apparatus 10 comprises 15 uncoilers, as those of skill in the art will appreciate, the illustrated apparatus 10 may comprise a different number of metallic strip uncoilers. Each metallic strip uncoiler 20(*a-o*) comprises a rotatable spindle 22 (*a-o*). As illustrated, a coil of amorphous metallic strip has been mounted or installed on each rotatable spindle of the uncoiler. In addition, each coil comprises a continuous amorphous metal strip 26(*a-o*) respectively, each of which the metallic strips 26(*a-o*) are wound in a single-layer thickness or single-ply. For example, as illustrated in FIGS. 1-3, a first coil 24*a* is mounted on a first rotatable spindle 22*a* of a first uncoiler 20*a*. Each uncoiler 20(*a-o*) is supported by a support structure 28(*a-o*).

Uncoiler Motors

Referring now to FIGS. 1-3, the apparatus 10 is illustrated as being adapted to receive a first coil 24*a* of amorphous steel ribbon 50. The first coil 24*a* is mounted on a fixed-axis rotatable spindle 22*a*. This rotatable spindle 22*a* is coupled to a rotor of an adjustable speed electric coil motor 44*a*. This motor 44*a*, when energized, drives the spindle 22*a* in a counterclockwise direction (as indicated by arrow x) to effect unwinding of the associated amorphous metallic strip 26*a*. Operation of the various other uncoiler motors 44 (*a-o*) along with the transporting mechanism and shearing mechanism is controlled by a master controller under operation of computerized servo motors.

For controlling the unwinding of the coils 24 (*a-o*) as the plurality of metallic strips 26 *a-o* are being unwound from their respective uncoiler, a suitable variable speed control 210 is provided for controlling the speed and torque characteristics of the plurality of electric motors 44 (*a-o*) energizing the respective uncoilers 20 (*a-o*). This variable speed control 210, which may be of a conventional ac or dc variable speed drive, can base its operation from the positioning data of how much material has been run. During the continuing unwinding of the coils 24 (*a-o*) and as the coils 24 (*a-o*) decrease in diameter through unwinding of the metallic strips 26 (*a-o*), the variable speed control 210 responds to this change in material diameter by causing the coil motors 44 (*a-o*) to increase their speed, thereby making available more unwound metallic strip material where necessary.

As will be described in greater detail below, the uncoiler motors 44 (*a-o*) are controlled via a master controller 204 comprising a variable speed drive 210 so that the plurality of single-layer thickness metallic strips 26 (*a-o*) from each of the coils 24(*a-o*) are unwound in a predetermined manner. These metallic strips are then combined within the collection tray 40 to form the composite strip 50 of multiple-layer thickness. Under control by the variable speed drive and along with the roll feed 100 of the shearing section 14, this composite metallic strip 50 is transported via the composite strip collection tray 40 towards the shearing section 14. (composite metallic strip 50 illustrated in FIG. 1 between the roll feed 100 and the shearing mechanism) At this shearing section 14, the composite metallic strip 50 is sheared into a plurality of metallic strip packets, each metallic strip packet having a predetermined number of packets and having a predetermined length, such as those packet grouping 400 illustrated in FIGS. 20 and 21.

Uncoiler Structure

As illustrated, preferably each uncoiler 20(*a-o*) is a free standing structure having its own support structure. More preferably, and as may be seen from FIGS. 1 and 3, each uncoiler is staggered one behind the other generally along a straight line along the manufacturing apparatus 10. Generally, as each metallic strip 26 (*a-o*) is unwound from its coil, the metallic strip is fed in a downward direction so as to maintain a certain degree of slack in the uncoiled metallic strip thereby forming an un-weighted loop 58 of metallic strip beneath uncoiler in a pit area 60. As the metallic strip material 26*a* is being unwound in a counterclockwise direction from the first coil 24*a*, the first amorphous strip 26*a* is advanced by gravity downwards so as to maintain a certain amount of slack. For example, as can be seen from FIGS. 1-3, an un-weighted loop 58*a* of the first metallic strip 26*a* resides beneath the first uncoiler support structure 28*a* in a first pit area 60*a*.

Tension Controller/Magnet

From the un-weighted loop, this metallic strip 26*a* is then transported or pulled over a tension controller 30*a*. In one preferred arrangement, this tension controller 30*a* preferably comprises a cylindrically shaped bearing surface 32*a*. In one preferred arrangement, this bearing surface 32*a* is provided with a magnetic element 36*a* that may be mechanically configured or coupled to the tension controller 30*a*. In this manner, the magnetic element 36*a* may be used to attract the metallic strip 28*a* to a top surface provided on the cylindrically shaped bearing surface 32*a*. Such a magnetic element 36*a* may be coupled either on a top or outer surface of the tension controller 30 or along a bottom or inner surface. A similar tension controller 30 may also provided on the other uncoilers 20(*b-o*) of apparatus 10 as well.

Towards Collection Tray

After the metallic strip progresses over this controlling surface member 30, the metallic strip 26*a* proceeds in a downward direction towards a composite strip collection tray 40. In this composite strip collection tray 40, the metallic strip may be combined with the other metallic strips that are unwound from the respective coils.

Then, the first amorphous strip 26*a* is advanced to the right in FIGS. 1-3 along the composite strip collection tray 40 towards the second uncoiler 20*b*. At this second uncoiler 20*b*, a second metallic strip 26*b* is then unwound from the second uncoiler 20*b* in a similar manner as discussed above with respect to the first uncoiler 20*a*. In this manner, the second metallic strip 26*b* is unwound from the second coil 24*b* and then placed within the composite strip collection tray 40 on top of the first metallic strip 26*a*. This same unwinding procedure is then repeated after each of the uncoilers 20 (*c-o*) residing downstream of the second uncoiler 20*b*. In this manner, immediately after the last uncoiler or fifteenth uncoiler 20*o*. The composite collecting tray 40 is used to transport a collection of a continuous web of the composite metallic strip 50. In this illustrated arrangement, this composite metallic strip comprises a 15 ply material of metallic material towards the shearing section 14 of apparatus 10.

Composite Strip Collection Tray to Shearing Section

Preferably, this composite strip collection tray 40 runs the length of the unwinding section 12, beginning at the first uncoiler 20*a* and continuing to run underneath the remaining uncoilers 20(*b-o*). In one preferred arrangement, the composite strip collection tray may proceed from the unwinding section 12 up into the shearing section 14 of the apparatus 10 by way of a ramp 42.

Shearing Section—Roll Feed

The composite amorphous strip 50 is advanced along the composite strip collection tray in a longitudinal direction by way of the roll feed 100. After the last uncoiler 20*o*, the composite metallic strip 50 is advanced to the right in FIG. 1 in part under the control of the shearing section 14, primarily by roll feed 100 under operation and under control of the variable speed drive 210. When the roll feed 100 is operated, the roll feed advances the composite metallic strip 50 to the right towards the spaced-apart blades 112 and 114 of a shearing device 110. Preferably, the composite strip 50 is advanced at a high speed along the collection tray 40 in a longitudinal direction.

Preferably, this roll feed 100 acts in cooperation with a variable speed drive operating each of the uncoiler motors 44 from the unwinding section 12. The variable speed drive and the roll feed 100 provide a degree of tension control for controlling the speed at which the roll feed 100 moves or drags the amorphous metallic strips 26 (*a-o*) off their respective uncoilers 20 (*a-o*). One advantage of such a configuration is that the variable speed drive can generally provide a smooth and continuous flow of the metallic strips 26 (*a-o*) (and hence the composite metallic strip 50) from uncoilers 24 (*a-o*) towards the shearing section 14. The roll feed 100 guides or directs the composite metallic strip 50 from the uncoilers 14 to the shearing section 14 as shown in FIG. 1.

Assisting the roll feed 100 in transporting the composite metallic material 50 is an accumulator 140. This accumulator 140 may comprise a first roll 142 and a second roll 144 which, as illustrated in FIG. 1, is located downstream from the shearing blades 112 and 114.

Shearing—Bridge Plate and Deflector

Figure 4:
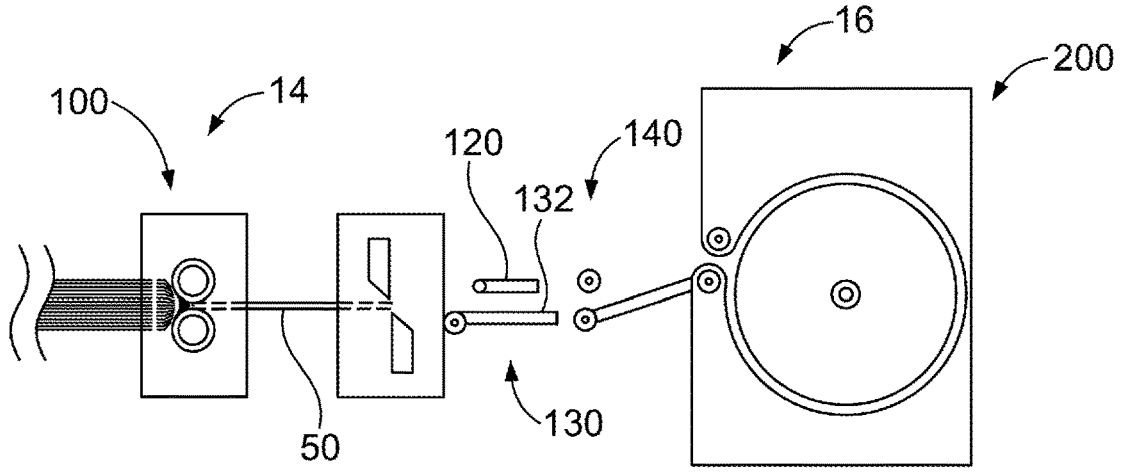
FIG. 4 illustrates an initial process step for forming a core of metallic strips.
Figure 5:
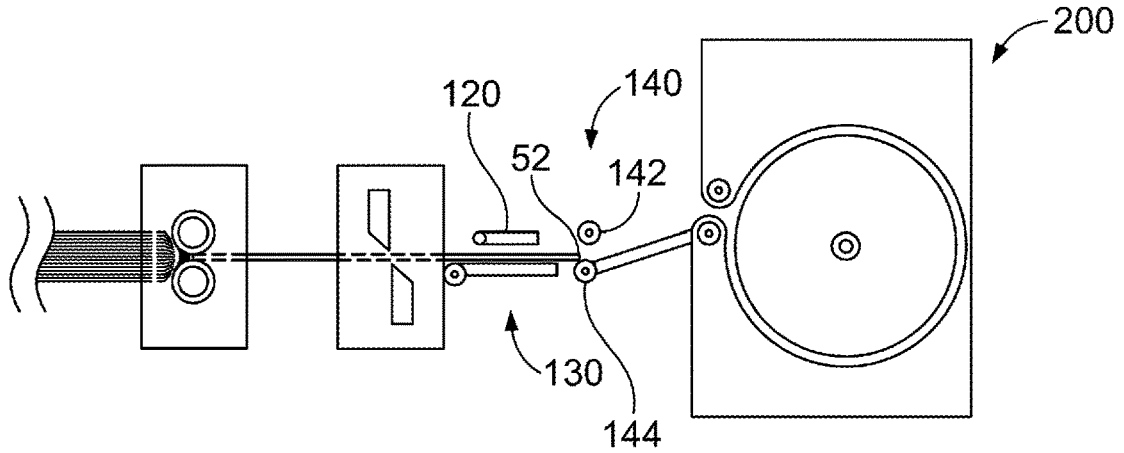
FIG. 5 illustrates an initial process step for forming a core of metallic strips.
Figure 6:
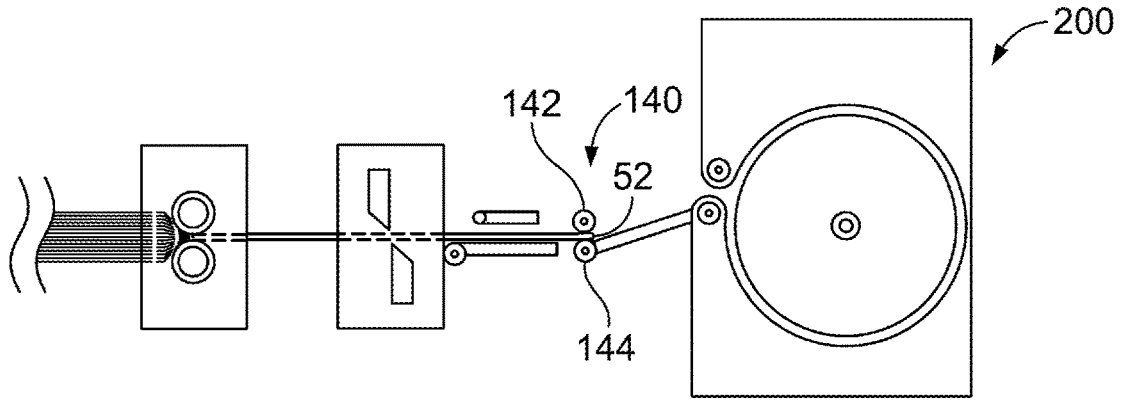
FIG. 6 illustrates another process step for forming a core of metallic strips.

FIG. 4 illustrates a next process step of the apparatus 10 illustrated in FIG. 1. Specifically, FIG. 4 illustrates a close up view of the shearing section 14 and winding section 16 of the apparatus 10 illustrated in FIG. 1. As illustrated in this next process step, the composite metallic strip 50 is advanced towards the shearing section 14 and specifically along a top surface 132 of a bridge plate 130 and underneath a deflector 120 of the apparatus 10. The roll feed 100 advances the composite strip 50 such that a first end 52 of the composite strip 50 enters into the accumulator 140 of the shearing section 14. This process step is illustrated in FIG. 5. Preferably, during an initial process step, this first end 52 of the composite strip 50 is advanced a certain predetermined distance into the accumulator 140. For example, such a predetermined distance can be on the order of between approximately 0.025-0.075 inches. In this preferred arrangement wherein the accumulator 140 comprises a first roll and a second roll, these rolls 142, 144 are controlled to move apart and pinch or compress together so as to hold the first end 52 of the composite strip 50. FIG. 6 illustrates the process step where a certain predetermined amount of the first end 52 of the composite metallic strip resides in and is held by the first and second rolls 142, 144 of the accumulator 140.

Figure 7:
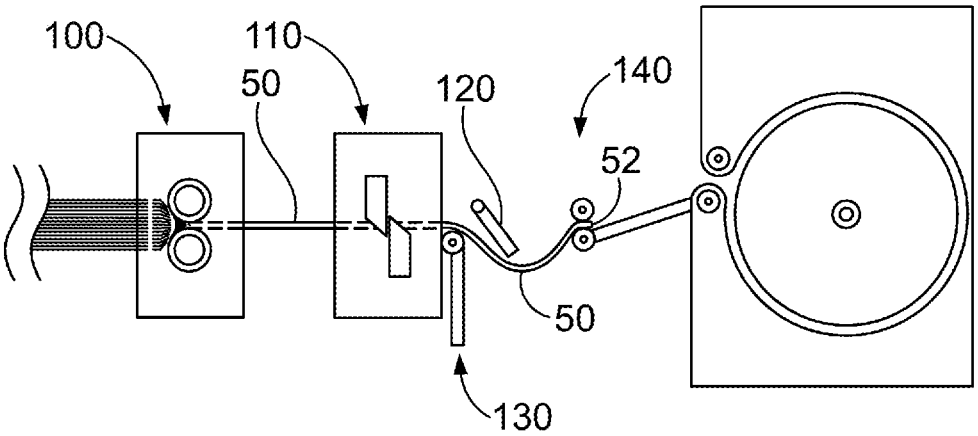
FIG. 7 illustrates another process step for forming a core of metallic strips.

FIG. 7 illustrates a next process step wherein the composite metallic strip 50 has been transported through the shear mechanism 14, along the top surface 132 of the bridge plate 130 and into the accumulator 140. As illustrated, the first and second rolls 142, 144 of the accumulator 140 are initially stopped. However, even though the accumulator 140 is stopped, the apparatus 10 will continue to operate the roll feed 100 so as to continuously feed the composite amorphous strip 50 into the shearing section 14, preferably at a certain set speed.

Specifically, and as shown in FIG. 7, wherein the accumulator roll 140 stops and then the bridge plate 130 moves from a first position or a closed position (bridge plate closed position is illustrated in FIG. 6) to a second position or an open position. In this apparatus arrangement, and as illustrated, the bridge plate 130 will be operated to swing in a downward direction, away from the composite strip 50 and away from deflector 120. Moving the bridge plate 130 to this second or open position allows the composite metallic strip 50 to begin to drape down under as the roll feed 100 is continued to be operated at a slow speed so as to continue to feed the composite strip 50 into the shearing section 14. During this feeding process step, the accumulator 140 remains in the stopped position but continues to hold the first end 52 of the composite strip 50.

Deflector Plate Moves

In addition, and as also illustrated in FIG. 7, during this process step the deflector 120 is moved from a first position or a non-deflecting position (this non-deflecting position of the deflector 120 is illustrated in FIG. 6) to a second position or a deflecting position. In this second or deflecting position, the deflector 120 is adjusted downwardly so that a bottom surface 122 of the deflector deflects the composite metallic strip 50 downward as the roll feed 100 continues to feed the composite metallic strip 50 towards the accumulator 72 again under a slow feeding speed.

Figure 8:
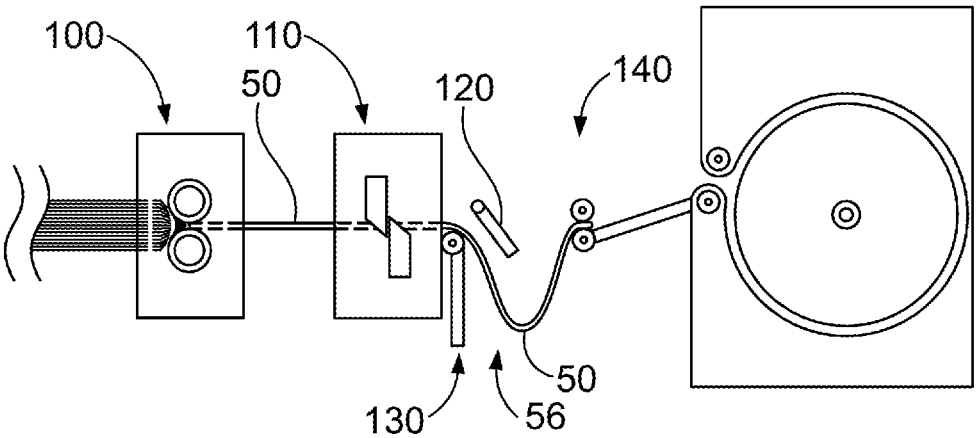
FIG. 8 illustrates another process step for forming a core of metallic strips.

FIG. 8 illustrates yet another step for processing the composite amorphous strip 50. As illustrated, as the bridge plate 130 and deflector 120 remain in their respective second positions (i.e., the bridge plate in the down position and the deflector plate in the deflecting position as illustrated in FIG. 7), the variable speed drive 210 of the apparatus 10 will continue to operate the roll feed 100 by accelerating and/or decelerating the roll feed 100 so that a first desired feed length of the composite metallic strip 50 is achieved. For example, as illustrated in FIG. 8, after this process step an un-weighted loop 56 of the desired feed length of the composite metallic strip 50 will resides below the deflector 120.

Shear Mechanism Activated

Figure 9:
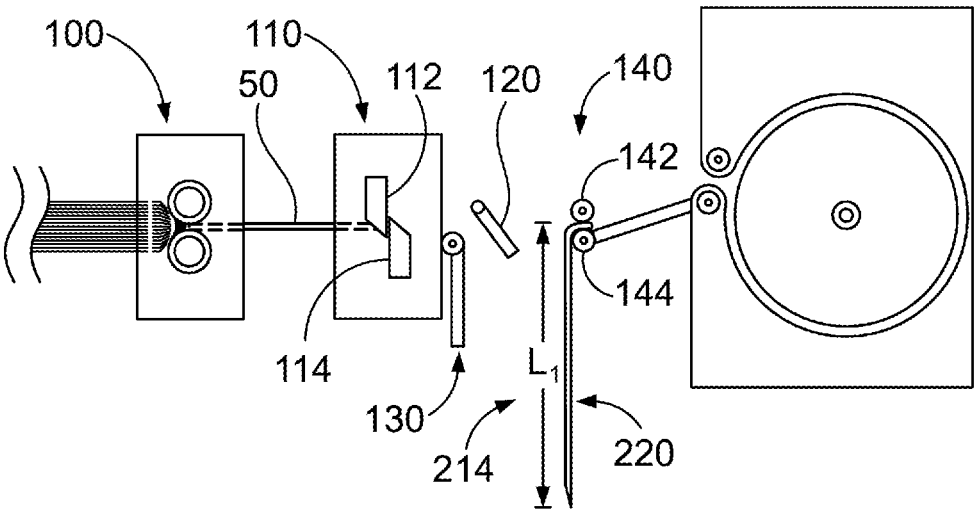
FIG. 9 illustrates another process step for forming a core of metallic strips.

FIG. 9 illustrates yet another process step after a desired feed length of the composite metallic strip has been achieved. That is, after the first desired feed length of the composite strip 50 has been determined, and as illustrated in FIG. 9, the shearing device 60 may be activated so as to shear the composite amorphous strip 50 thereby creating a first grouping or packets of amorphous metal strips 220 having a desired length L 70. As illustrated in FIG. 9, activating shear device 110 utilizes the first and second blade 112, 114 to shear the composite strip 50 at the first desired length L1 70 so that a first packet or grouping of strips 220 of the composite metallic strip 50 is provided.

Shearing at this first desired length with the bridge plate 130 remaining in the second or open position and the deflector 120 remaining in its second or deflecting position, allows a sheared end 222 of the first strip grouping 220 to fall downward. Similarly, the first end 52 of the composite amorphous strip or what is now the first end 52 of the first packet 220 of metallic strips remains pinched between the first roll 142 and the second roll 144 of the accumulator 140.

Shearing Second Packet

Figure 10:
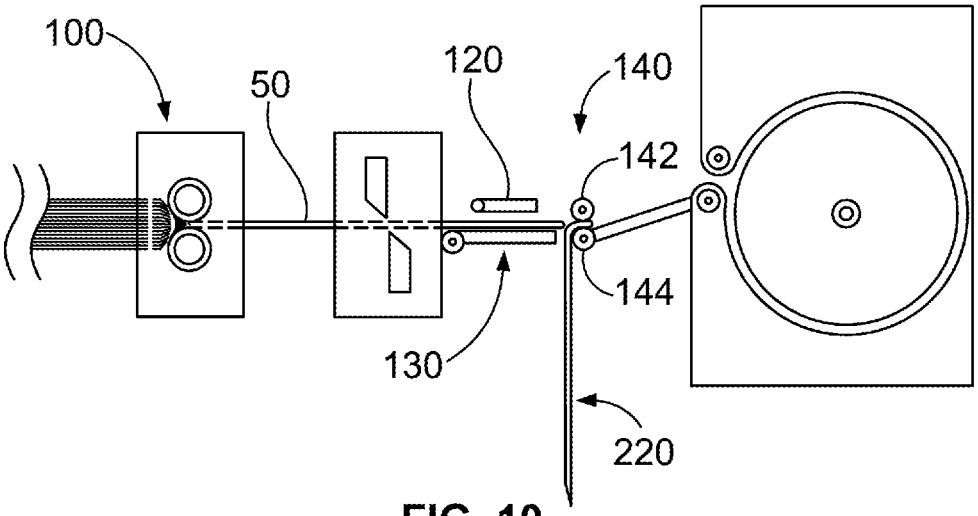
FIG. 10 illustrates another process step for forming a core of metallic strips.

FIG. 10 illustrates a next process step for shearing a second amorphous strip grouping. In this next process step, the apparatus 10 resets to its original position by returning the deflector 120 to its first or closed position. The apparatus also returns the bridge plate 130 to its initial or closed position. After both the deflector 120 and bridge plate 130 have been returned to their initial positions, the apparatus 10 is now ready to shear a second grouping or packet of the composite metallic strip 50.

In one preferred arrangement, during this second shearing process step, the composite amorphous strip 50 will not be of the same length $L_1$ 70 as the first strip grouping that was sheared in FIG. 9. With this next process step, the composite metallic strip 50 is advanced by the roll feed 100 again at a high process speed through the shear mechanism 14 and advanced again over the bridge plate 130. At this high speed, the composite metallic strip 50 is advanced until a new first edge 54 of the composite strip 50 is provided into the first and second rolls 142, 144 of the accumulator 140.

In this manner, the first end 54 of the composite strip 50 will reside above or reside adjacent the first amorphous strip grouping 220 having the first desired length L1 214. Preferably, the speed of the roll feed 100 and the speed of the rolls 142, 144 of the accumulator are synchronized by way of the variable speed drive system and position control. The variable speed drive system advances the composite strip 50 so that the first edge 54 of the composite ribbon strip 50 is generally square with the first edge 52 of the first packet 220.

Figure 11:
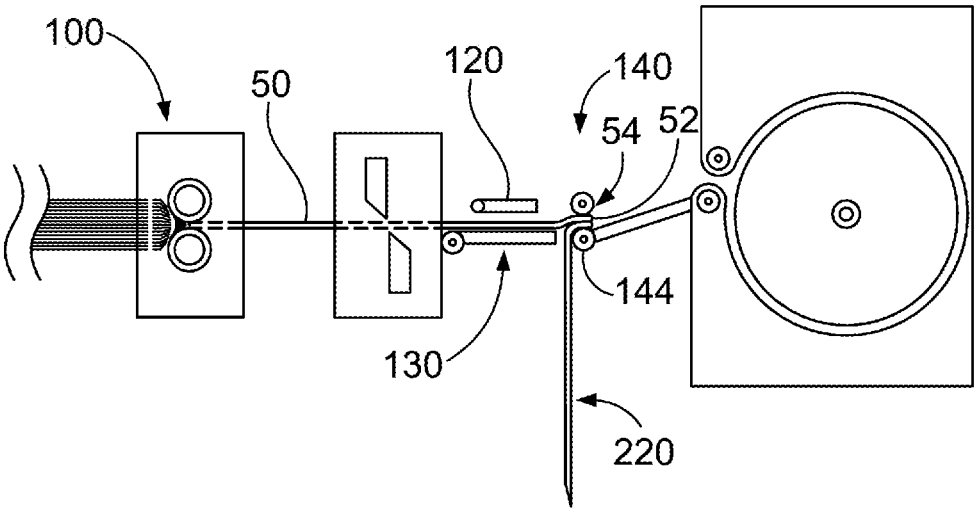
FIG. 11 illustrates another process step for forming a core of metallic strips.

Under control of the variable speed drive system, the roll feed 100 and the rolls 142, 144 of the accumulator 140 move in a synchronized fashion so that the composite ribbon 50 is advanced to a predetermined/calculated overlap length of the new first edge 54 of the composite strip 50 and the first edge 52 of the first metallic strip packet 220. This predetermined or calculated overlap lengths are determined based on the joints to be formed in the transformer core, such as the joints 212 of the transformer core illustrated in FIG. 22. In one preferred arrangement, the overlap between these two edges may be on the order of from approximately 0.55 to about 0.875 inches. This step is illustrated in FIG. 11.

Figure 12:
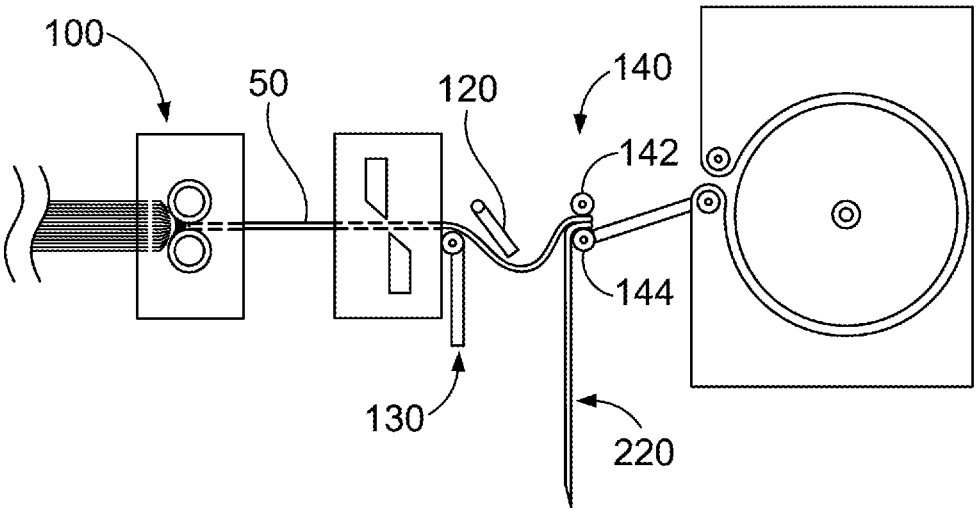
FIG. 12 illustrates another process step for forming a core of metallic strips.
Figure 13:
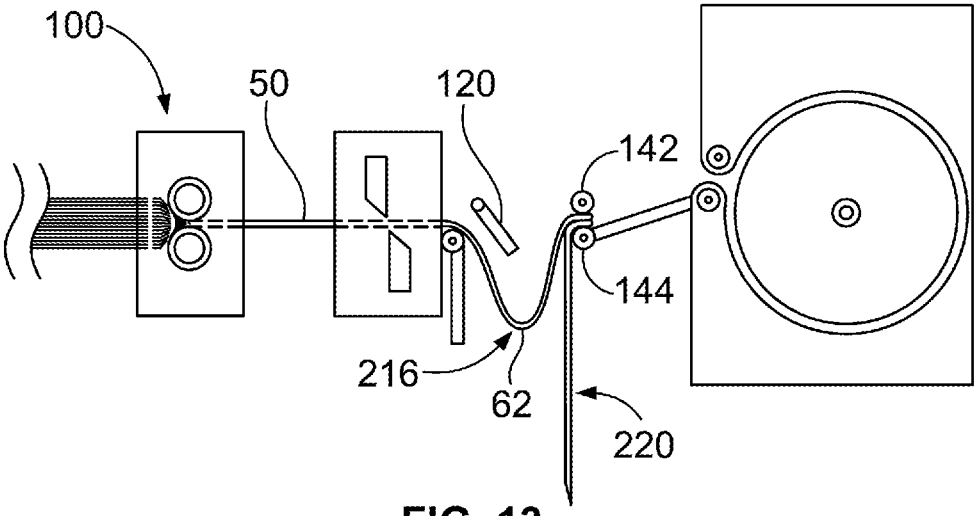
FIG. 13 illustrates another process step for forming a core of metallic strips.

FIG. 12 illustrates a next process step for a second shearing step of the composite metallic strip 50. As illustrated, the rolls 142, 144 of the accumulator 140 are stopped while the roll feed 100 continues to feed the composite amorphous ribbon 50 at a certain set speed. Then, similar to the process step described above, the bridge plate 130 is moved from its first position or a closed position (as shown in FIG. 11) to a second position or an open position. This again allows the composite metallic strip 50 to again drape down as the roll feed 100 continues to feed the composite strip 50 at a slow speed while the rolls 142, 144 of the accumulator roll remain in the stopped position. In this stopped position, rolls 142, 144 continue to grip the first end 52 of the first metallic packet 220 and the new first end 54 of the composite metallic strip 50. Once again, the deflector 120 is moved from to the non-deflecting position to the deflecting position, so as to deflect the composite strip 50 downward. As previously explained, and as illustrated in FIG. 13, the roll feed 100 continues to feed the composite strip 50 towards the accumulator 140 under a slow speed as a second un-weighted loop 62 of metallic composite strip 50 begins to build up under the deflector.

Figure 14:
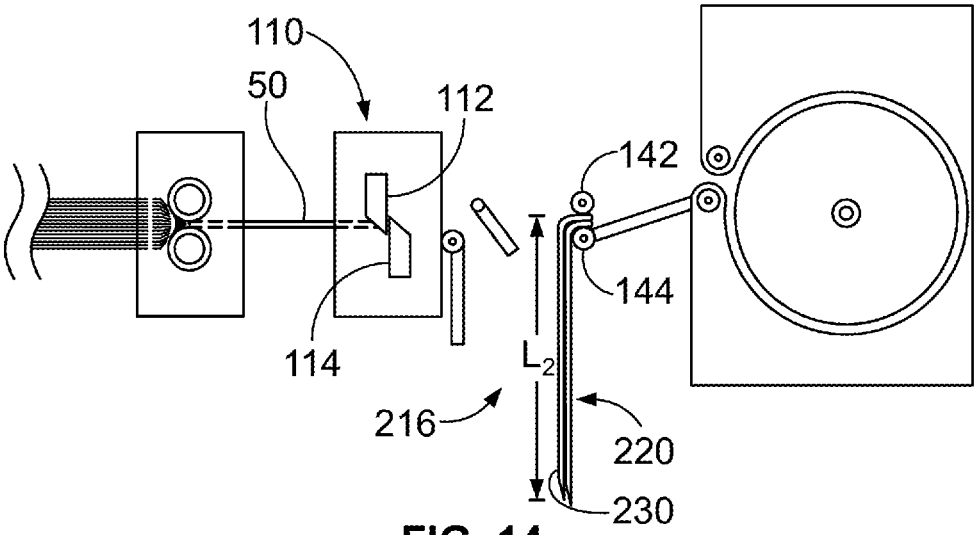
FIG. 14 illustrates another process step for forming a core of metallic strips.

FIG. 14 illustrates yet another process step of the apparatus. As illustrated, as the bridge plate 130 and deflector 120 remain in these second positions, the apparatus continues to operate the roll feed 100 so that a new or second desired feed length 216 of the composite strip 50 is fed into the shearing section 14 by the roll feed 100 while the accumulator still holds onto the first packet of metallic strips 220. This new or second desired feed length 216 may or may not be the same length as the first desired length $L_1$ 214 of the first packet of metallic strips 220 processed in accordance with FIGS. 4-9.

After the new desired feed length $L_2$ 216 of the composite metallic strip 50 has been determined, and as illustrated in FIG. 14, the blades 112, 114 of the shear mechanism 110 are closed so as to shear the composite metallic strip 50 at this desired length 216 thereby producing a second metallic strip packet 230 having this second desired length 216. Shearing at this second desired length 216 with the bridge plate 130 in the second position and the deflector 120 in its second position, allows a second end or a loose end of a second metallic strip to fall downward while the first end of the second amorphous strip remains between the first and second rolls 142, 144 in the accumulator 140. Therefore, and as illustrated in FIG. 14, the first metallic strip packet 220 having the first desired length $L_1$ 214 will reside adjacent the second metallic strip packet 230 having the second desired length $L_2$ 216 and both strips 220, 230 will be held together by the accumulator rolls 142, 144. As described above, the first desired length 214 may or may not be equal to the second device length 216.

Figure 15:
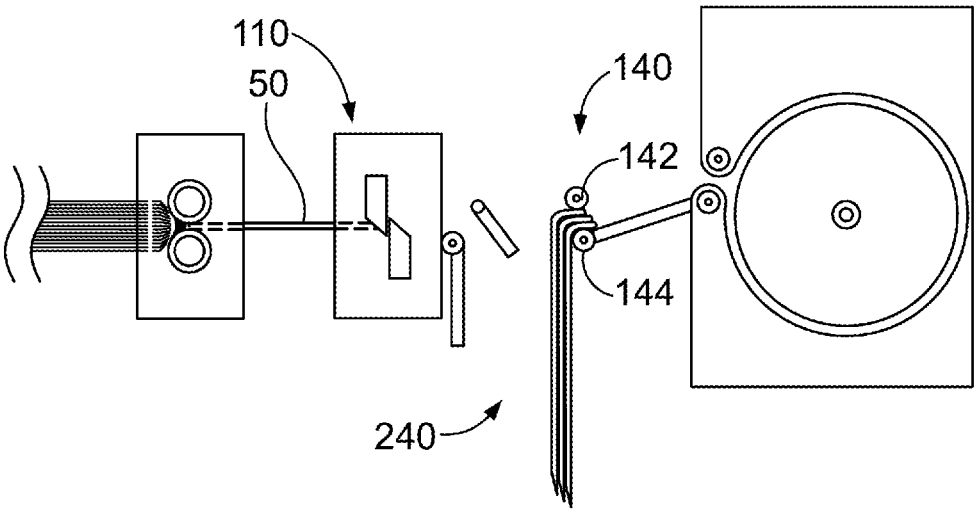
FIG. 15 illustrates another process step for forming a core of metallic strips.

The process of shearing the composite strip 50 at the various desired lengths can be repeated until a desired number of strip packets or groupings is obtained in the accumulator 140. For example, FIG. 15 illustrates a next process step of the presently disclosed method and apparatus wherein a desired collection 240 of a desired number of metallic strip packets are held between the first and the second roll 142, 144 of the accumulator 140. In this preferred arrangement, such a desired collection of packet strips 240 may comprise 15 strip packets. However, those of ordinary skill in the art will recognize that the accumulator 140 may be configured to accumulate a desired collection of packet strips 240 comprising a different number of strip packets ranging in number from 5-500 strip packets.

Figure 16:
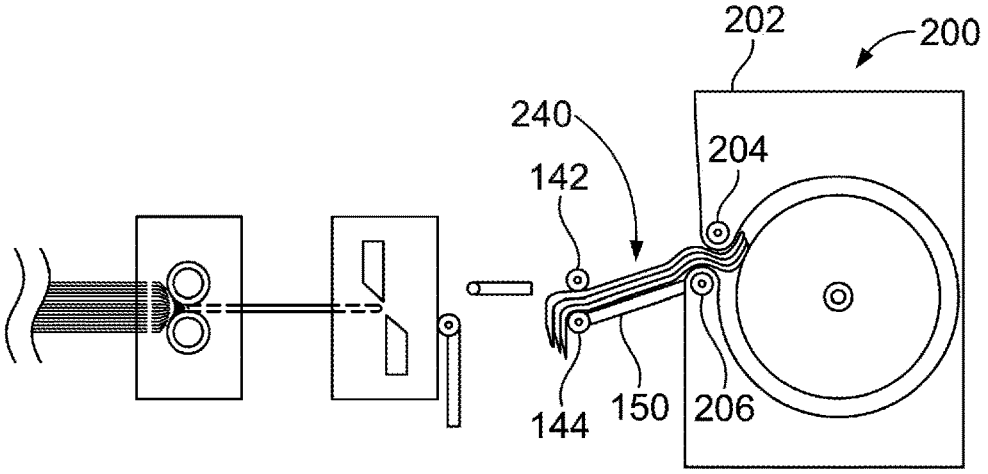
FIG. 16 illustrates another process step for forming a core of metallic strips.
Figure 17:
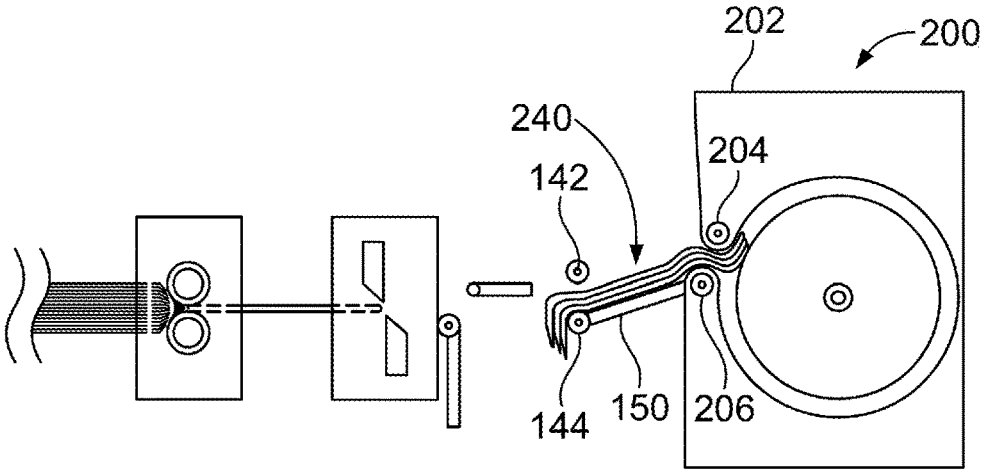
FIG. 17 illustrates another process step for forming a core of metallic strips.

Once the desired collection of packet strips 240 are obtained, the process then continues as illustrated in FIG. 16. For example, in this next process step, the apparatus 10 runs the rolls 142, 144 of the accumulator 140 so as to advance the desired collection of packet strips 240 into the winding section 16. Specifically, the desired collection of packet strips 240 are advanced as the first and second rolls 144, 144 feed the collection for strips 240 towards the first and second rolls 204, 206 of the winder at a synchronized speed. The winder rolls 204, 206 and the rolls 142, 144 of the accumulator 140 are operated at a synchronized speed. In this preferred illustrated arrangement, the rolls 204, 206 of the winder and the rolls 142, 144 of the accumulator rolls stop once all the packets are held between the built up core and the winding belt 202.

Figure 18:
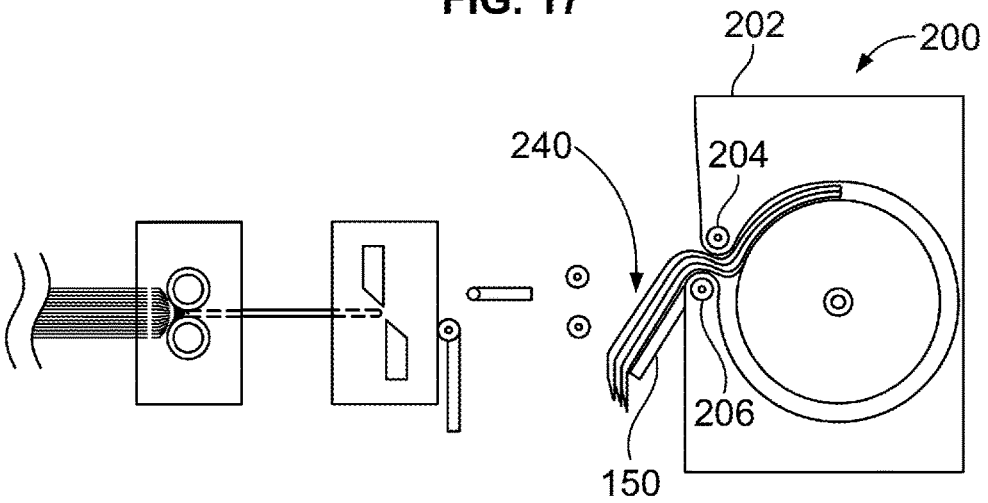
FIG. 18 illustrates another process step for forming a core of metallic strips.

FIG. 18 illustrates a next process step. As shown in FIG. 18, the rolls 142, 144 of the accumulator 140 will open up so that the collection of packets 240 are no longer pinched between the rolls 142, 144. Then, moreover, the guide plate 150 then moves from a first position into a second position so that the rolls 142, 144 of the accumulator 140 retract and the collection of packets 240 are no longer in contact with the accumulator rolls 142, 144. In this manner, the collection of packets 240 can be continuously fed into the winder 200 and the rolls 142, 144 of the accumulator can then be repositioned to their original position so that they unwinding section 12 and the shearing section 16 of the apparatus 10 can be operated to process a second collection of packets 250.

Figure 19:
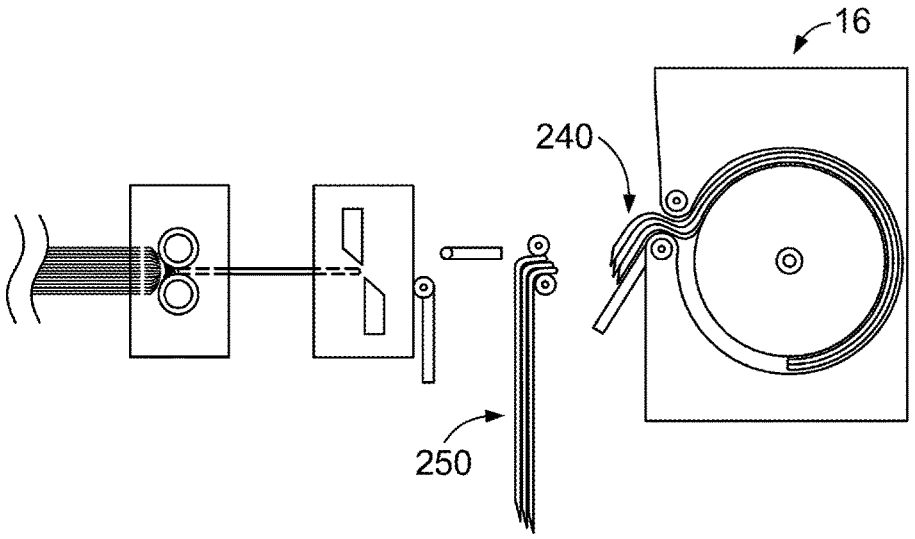
FIG. 19 illustrates another process step for forming a core of metallic strips.

For example, FIG. 19 illustrates a next process step. As illustrated in FIG. 19, the winder section 16 continues to be operated so that it continues to wind the entire collection of first packets 240. As this occurs, the above steps of shearing a second packets of metallic strips 250 may be reproduced as the winding section 16 continues to wind the first collection of packets 240 about the abor. In one arrangement, up to three packets may be accumulated in accumulator rolls 142, 144 before the guide plate must be closed. For example, FIG. 20 illustrates a next process step. Specifically, as illustrated in FIG. 19, as the winder continues to wind the first collection 240 onto the arbor to form a transformer core, the shearing section 14 is operated (as previously described) so that a second collection of packets is assembled in the accumulator 140. As such, the presently disclosed method and system of amorphous transformer core can be operated in a continuous feed manner.

Exemplary embodiments of the present invention have been described. Those skilled in the art will understand, however, that changes and modifications may be made to these embodiments without departing from the true scope and spirit of the present invention, which is defined by the claims.

I claim:

1. A method of assembling an amorphous metal core comprising the steps of:

providing at least one coil of amorphous metallic strip;

unwinding said amorphous metallic strip from said coil;

utilizing a roll feed to transport said amorphous strip along a longitudinal direction through a shearing section, along a bridge plate and into an accumulator roll;

advancing a first end of the amorphous strip into the accumulator roll a predetermined distance;

stopping the accumulator roll while the roll feed continues to feed the amorphous strip at a set speed;

moving the bridge plate from a first closed position to a second open position;

moving a deflector plate from a first non-deflecting position to a second deflecting position;

continuing to operate the roll feed so that a first desired feed length of the amorphous strip is achieved; and closing a shear mechanism of the shearing section to shear the amorphous strip at the first desired feed length to produce a first amorphous strip comprising the first desired feed length.

2. The method of claim 1 wherein a speed of the roll feed and a speed of the accumulator roll are synchronized by way of a variable speed drive system and position control.

3. The method of claim 1 further comprising operating the method in a continuous feed.

4. The method of claim 1 wherein the accumulator roll comprises a first roll and a second roll, the accumulator roll being located downstream from the shearing section.

5. The method of claim 4, wherein the first roll and second roll are configured to move apart and pinch or compress together so as to hold the first end of the amorphous strip.

6. The method of claim 5 wherein the shearing section includes a guide plate configured to guide the amorphous strips, wherein the guide plate moves from a first position into a second position to retract the first and second rolls of the accumulator roll.

7. The method of claim 1 wherein the unwinding step is carried out via an unwinding section, the unwinding section comprising fifteen uncoilers, each uncoiler comprising a variable speed motor operated by a variable speed drive.

8. The method of claim 7 wherein the roll feed guides or directs the amorphous strip from the uncoilers to the shearing section.

9. The method of claim 7 wherein the variable speed drive and roll feed provide a degree of tension control for controlling the speed at which the roll feed moves the amorphous metallic strips off of respective uncoilers.

10. The method of claim 7 further comprising an amorphous strip collection tray which proceeds from the unwinding section into the shearing section by way of a ramp.

11. The method of claim 10 further comprising advancing the amorphous strip at a high speed along the collection tray in a longitudinal direction.

12. The method of claim 1 wherein the bridge plate is configured to swing in a downward direction.

* * * * *